United States Patent [19]

Goncalves

[11] 4,132,308

[45] Jan. 2, 1979

[54] DISPENSING CONTAINER FOR STORING TWO PRODUCTS SEPARATELY AND DISPENSING THEM AS A MIXTURE

[75] Inventor: Antonin Goncalves, Groslay, France

[73] Assignee: L'Oreal, Paris, France

[21] Appl. No.: 849,720

[22] Filed: Nov. 8, 1977

[30] Foreign Application Priority Data

Nov. 15, 1976 [FR] France ..... 76 34311

[51] Int. Cl.[2] ..... B65D 25/08

[52] U.S. Cl. ..... 206/219; 215/DIG. 8; 220/23

[58] Field of Search ..... 222/83.5, 82, 86, 88; 215/DIG. 8; 206/222, 219; 220/23; 128/272, 272.1, DIG. 28

[56] References Cited

U.S. PATENT DOCUMENTS

| | | | |
|---|---|---|---|
| 3,458,076 | 7/1969 | Babcock | 215/DIG. 8 |
| 3,613,955 | 10/1971 | Wetherell | 215/DIG. 8 |
| 3,840,136 | 10/1974 | Lanfranconi et al. | 222/83.5 X |
| 3,966,089 | 6/1976 | Klingaman | 222/88 |

*Primary Examiner*—Robert B. Reeves
*Assistant Examiner*—John P. Shannon
*Attorney, Agent, or Firm*—Brisebois & Kruger

[57] ABSTRACT

A container for separate storage includes a receptacle for a liquid product, a retaining sleeve having a detachable capsule integrally molded therewith to be separated by tearing of a rupturable wall portion joining the capsule and sleeve for releasing an additional product in the capsule into the liquid product as the capsule falls into the receptacle, and a stopper including a dispensing spout.

The stopper is fixed to the retaining sleeve for conjoint rotation around the receptacle neck, and the capsule and the receptacle neck have interengageable reliefs to hold the capsule against rotation whereby twisting the stopper will rotate the sleeve to tear the rupturable wall portion, releasing the capsule.

Mixing of the two products may be assisted by the user shaking the container, and the ensuing mixture may be dispensed through the stopper spout.

12 Claims, 3 Drawing Figures

DISPENSING CONTAINER FOR STORING TWO PRODUCTS SEPARATELY AND DISPENSING THEM AS A MIXTURE

The present invention relates to a container for storing and dispensing a mixture obtained from a liquid product and an additional product, said products being isolated one from another before the dispensing operation.

There have already been proposed, for this purpose, numerous devices permitting storing, in isolation in a single pack, of two products, at least one of which is liquid, and for mixing the products just before use. French Patent Application No. 75-35033 filed on Nov. 17, 1975 discloses a container of this type whose neck is closed by a stopper serving as a dispensing spout, the liquid product being contained in the body of the container which constitutes a first compartment. On the inner face of the stopper at the neck of the container is an ejectable capsule, temporarily held in place during storage, and defining with the stopper a second compartment within which the additional product is placed. For provoking depression and ejection of the releasable capsule into the bottom of the container, and for thus contacting the liquid contained in the body of the container with the additional product, the user must rock the dispensing spout laterally causing it to hinge about a deformable wall zone, in the form of a dome, where the capsule is disposed. By virtue of its simplicity, a storage device of this type is particularly economical.

Nevertheless, the above described device is only usable when it is desired to store a small volume of additional product in the second compartment. For a more considerable volume of additional product such a system can be used only with difficulty because of technical problems consisting of on the one hand the need for reliable sealing between the two compartments despite the increased surface area, and on the other hand the construction of a thin wall zone constituting the deformable zone.

It is an object of the present invention to overcome these disadvantages in a storage and dispensing device permitting rigorous isolation between the two compartments to be assured using a cheap design and construction of container, even when storing a relatively considerable volume of additional product.

It is a further object of the invention to provide a dispensing container in which the user may effect mixing of two separately stored products simply by rotating a closure cap relative to the container body without opening the container.

In accordance with the present invention there is provided a container for storing a liquid product and an additional product isolated from one another during storage and for dispensing said products as a mixture, such container comprising: a receptacle whose neck is closed by a stopper and whose body constitutes a first compartment in which one of said products is to be placed; a capsule disposed in said neck and within said stopper so that during storage the stopper co-operates with said capsule to define a second compartment in which the other product is placed; and a retaining sleeve rotatably supported on said receptacle to mount said capsule in the receptacle neck; wherein the capsule is in the form of a cup whose lateral wall is disposed at least partially in said neck, wherein the part of said wall which is within the neck presents externally at least one relief capable of engaging against another relief provided on the internal surface of said receptacle neck to hold the capsule against rotation with respect to the neck, wherein said capsule is joined to said retaining sleeve by means of a rupturable peripheral wall zone, and wherein said stopper is fixed on the retaining sleeve so as to entrain said retaining sleeve for rotation about the receptacle neck when said stopper is twisted for rotation around said neck.

Since the capsule comprises a relief on its lateral peripheral wall capable of abutting a corresponding relief on the internal surface of the neck, a rotational movement of the stopper fixed to the sealing sheath will allow the user to provoke tearing of the rupturable wall zone which joins the capsule to the retaining sheath once the capsule becomes held against rotation within the neck by engagement of the reliefs of the neck and capsule. The capsule, once detached, falls to the bottom of the receptacle bringing the two products into contact with one another to be intimately mixed by agitation of the container by the user.

The storage device according to the invention has the advantage that perfect sealing between the two compartments, may be assured without the need for a sealing gasket which is particularly difficult to form, as in French Patent Application No. 75-35033. With the present invention the compartments are separated in sealed manner by a continuous narrow rupturable wall zone.

In addition to this there is the fact that the container according to the invention is very reliable and clean, assuring in all circumstances separation of the capsule and its release into the receptacle by a simple rotational movement of the stopper.

Another important advantage of the container according to the invention is its simplicity of manufacture and consequently its cheapness since it is constituted of assembly of three components, advantageously molded in plastics material, consisting of a receptacle, an integrally molded assembly of retaining sleeve and capsule, and finally a stopper, preferably including a dispensing nozzle.

In a preferred form, the retaining sleeve comprises, in its zone of fixing to the neck of the receptacle, on the one hand an outer skirt and on the other hand an inner skirt disposed concentrically with respect to the outer skirt, these two skirts being disposed to one side and another of the neck of the receptacle in the assembled condition of the container, the capsule engaging with the said inner skirt by way of the rupturable peripheral wall zone. Between the inner and outer skirts of the retaining sleeve is an annular sealing lip, such that the outer skirt and the sealing lip define together a channel comprising a catch to facilitate fixing of the retaining sleeve on the neck of the receptacle in that the rim of the neck of the receptacle is engaged in said channel by a ratchet action. The capsule comprises a lateral substantially cylindrical wall which carries several external teeth preferably disposed regularly around its periphery, these teeth extending parallel to the generatrices of said lateral wall; the neck of the container has an internal substantially cylindrical surface with several teeth, preferably disposed regularly about its periphery, said teeth being disposed parallel to the generatrices of said internal surface. The radially inner faces of the teeth of the neck define a right circular cylinder, and so do the radially outer faces of the teeth of the capsule. The diameter of the cylinder defined by the faces of the teeth of the capsule is less than the internal diameter of the receptacle neck between two adjacent teeth, and the diameter of the cylinder defined by the faces of the teeth in the receptacle neck is greater than the external diameter of the lateral wall of the cup between two adjacent teeth thereof.

The stopper comprises, in its zone of fixing on the retaining sleeve, an external skirt of generally cylindrical form disposed coaxially with the receptacle neck, said skirt surrounding an annular sealing rib which engages on one end of the radially inner face of the sleeve. The skirt and the sealing rib of the stopper define an annular recess comprising a catch bead such that the stopper may be fixed on the retaining sleeve by ratchet-type engagement of said bead in an external annular groove provided on the end of the retaining sleeve which is positioned in the said annular recess of the stopper.

The skirt of the stopper has on its internal surface channels disposed side-by-side and parallel to the generatrices of the cylindrical internal surface of the stopper, and the outer skirt of the retaining sleeve comprises, on its cylindrical surface situated in register with the stopper skirt, striations disposed side-by-side and parallel to the generatrices of the said surface, so that the ribs of the sleeve (each defined by two contiguous channels) come into engagement in the striations of the retaining sleeve to hold the stopper against rotation with respect to the sleeve.

The stopper comprises a dispensing spout; the axis of the spout coincides substantially with that of the receptacle neck; the dispensing spout is of conical form, with its diameter decreasing in a direction towards its free end. The dispensing spout defines at its free end a discharge orifice initially closed by a wall zone intended to be cut off or torn off at the moment of dispensing.

In order that the present invention may be better understood, there will now be described, by way of purely illustrative and non-limiting example, one embodiment shown on the accompanying drawings, in which.

Figure 1:
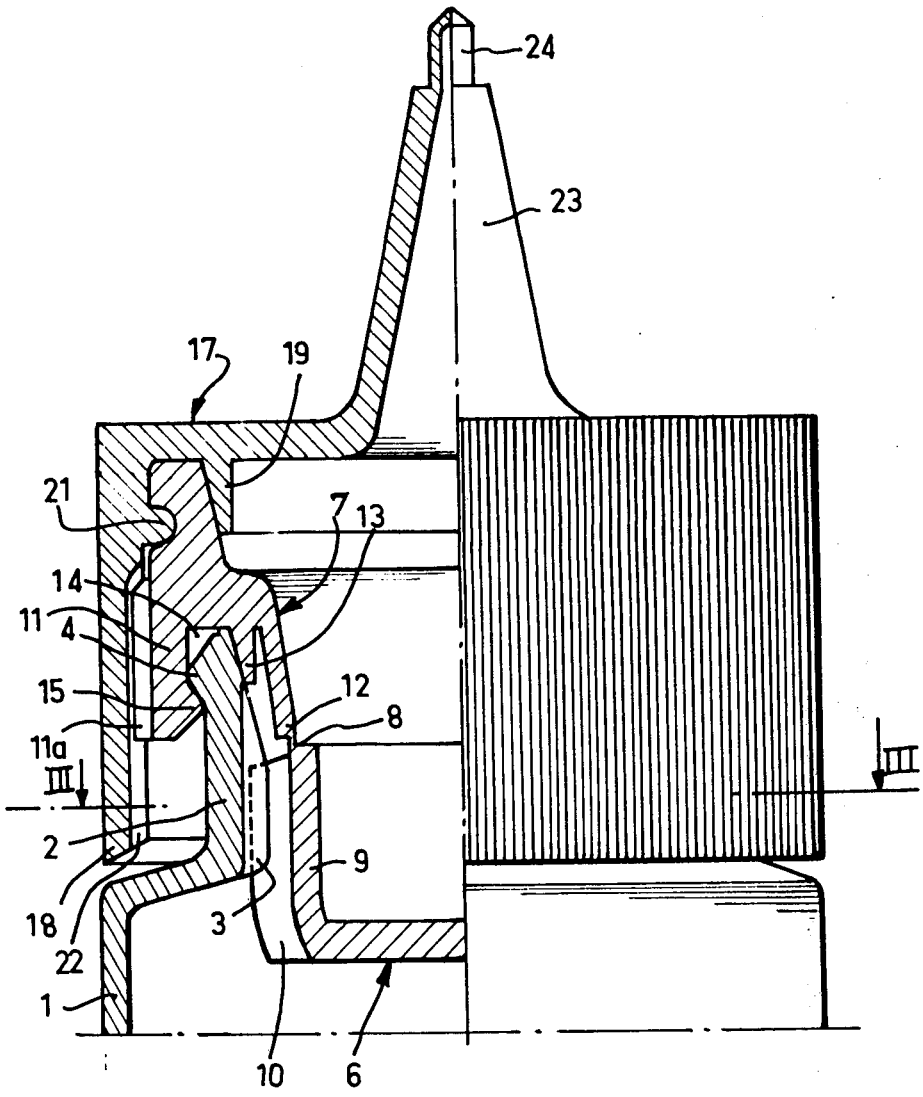
FIG. 1 shows, partially in axial section and partially in external view, one form of storage and dispensing container according to the invention.
Figure 2:
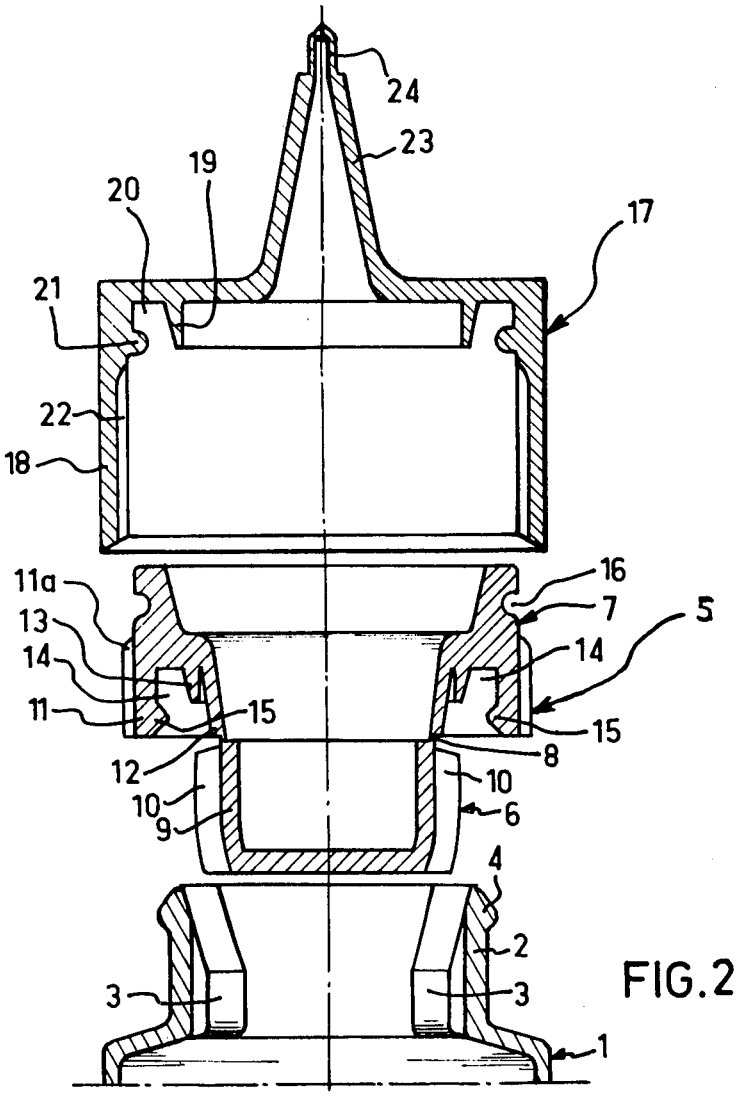
FIG. 2 shows in axial section and front assembly the different elements constituting the container of FIG. 1.
Figure 3:
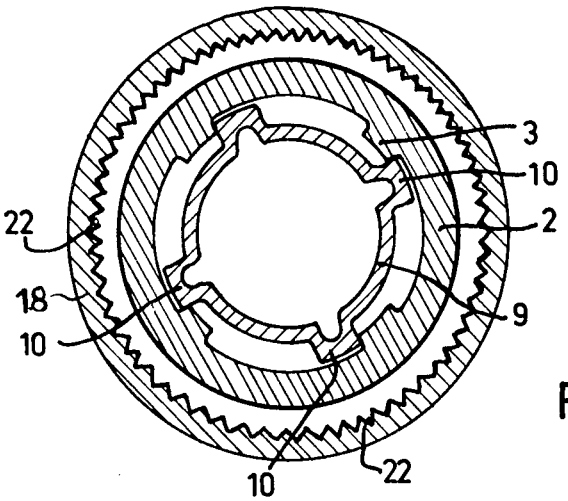
FIG. 3 shows a section along III—III of the container of FIG. 1.

Referring to the drawing, there may be seen a bottle 1 which provides the receptacle of the storage and dispensing container according to the invention. The bottle is formed of polyvinyl chloride and has four teeth 3 provided in relief on the interior surface of its neck 2. The four teeth 3 are regularly disposed at 90° from one another and each extends parallel to the generatrices of the internal cylindrical surface of the neck 2. The end of the neck 2 is bounded, in conventional manner, by an outwardly projecting annular rim 4. The bottle 1 constitutes the first compartment of the storage container, to receive the liquid product of the mixture to be dispensed.

The neck 2 of the bottle 1 is adapted to receive an assembly 5 molded as a single unit, of polyethylene. This assembly 5 comprises a detachable capsule 6 intended to be disposed within the neck 2 and a retaining sleeve 7 intended to be assembled on the neck 2. The capsule 6 is connected to the sleeve 7 by a rupturable, narrow-walled peripheral zone 8.

The capsule 6 is in the form of a cup whose lateral wall 9, of generally cylindrical form, engages the retaining sleeve 7 through the intermediary of the rupturable peripheral wall zone 8. The capsule 6 has externally four teeth 10 provided in relief on its lateral wall 9. These four teeth 10, disposed regularly at 90° intervals, extend substantially along the entire height of the capsule 6 and are disposed parallel to the generatrices of the cylindrical lateral wall 9 of the capsule.

The capsule 6 is maintained within the neck 2 of the container only by the rupturable peripheral wall zone 8. The external diameter of the capsule 6, measured between the end edges of two diametrally opposed teeth 10 has a value between (a) the internal diameter of the neck 2 measured to the floor of the recess between two teeth 3 and (b) the internal diameter of the neck 2 measured between the end edges of two diametrically opposed teeth 3.

The retaining sleeve 7, of generally cylindrical form, has its longitudinal axis substantially coaxial with that of the neck 2 of the container on which it is fixed. The sleeve 7 has an external skirt 11 in its zone of fixing on the neck 2 of the bottle and, disposed concentrically with the latter, an internal skirt 12. The internal skirt 12 engages, at its end situated within the neck 2, with the rupturable peripheral wall zone 8. The internal skirt 12 of the sleeve 7 is substantially disposed as an extension of the lateral wall 9 of the capsule 6.

Between the two skirts 11 and 12 of the retaining sleeve 7 is an annular sealing lip 13 which adjusts itself on the inner face of the neck 2. The external skirt 11 and the sealing lip 13 define an annular groove 14 equipped with a catch 15.

For placing the retaining sleeve 7 on the neck 2 of the bottle 1, it is necessary to engage the rim of the bottle neck 2 in the groove 14 by detent action. It should be noted that the connection thus provided between the retaining sleeve 7 and the neck 2 is a loose union because the sleeve 7 is capable of rotating with respect to the neck.

The external skirt 11 of the sleeve 7 is provided with radially outer striations **11*a* disposed side-by-side and parallel to the generatrices of the external cylindrical surface of skirt 11. The striations 11*a*** are all identical and have a triangular cross section.

At its upper end opposite to that where it engages the capsule 6, the retaining sleeve 7 has an annular groove 16 serving to ensure a releasable coupling of the sleeve with a stopper 17 serving as a dispensing cap. The stopper 17, of generally cylindrical form, has at its zone of fixing to the retaining sleeve 7, an external skirt 18 of right circular cross section which extends across the entire axial extent of the outer skirt 11 of the sleeve 7.

Within its external skirt 18, the stopper 17 also comprises a sealing rib 19 which comes into engagement with the corresponding end of the inner wall of the sleeve 7. The sealing rib 19 and the skirt 18 define together an annular recess 20 comprising a catch bead 21. For assembling the stopper 17 with the retaining sleeve 7, the bead 21 is ratchet-engaged in the groove 16 which is positioned in the annular recess 20 of the sleeve 7. However, this connection between the stopper 17 and the retaining sleeve 7 is loose since that it permits rotation of the stopper 17 relative to the retaining sleeve 7. Consequently, to ensure holding of the stopper 17 against rotation with respect to the sleeve 7, the internal surface of the skirt 18 has triangular profile channels 22 of a shape and size identical to the striations **11*a***. The channels 22 are disposed side-by-side and parallel to the generatrices of the cylindrical inner surface of the skirt 18 and they extend from the lower free end of the skirt 18 just to the bead 21. The co-operation of the ribs each comprised between two contiguous channels 22 of the stopper 17 with the striations 16 of the sleeve 7 prevents rotation of the stopper 17 relative to the sleeve 7 when it is fixed thereon.

The stopper 17 also comprises, in conventional manner, a dispensing spout 23 whose axis substantially coincides with that of the container neck 2. The dispensing spout 23 is of conical form having its diameter decreasing in a direction towards its tip 24 and defines at its end 24 a discharge orifice initially closed by a detachable wall zone which the user may, as soon as mixing has been achieved, readily cut away to allow dispensing of the mixture.

The stopper 17 which has been described above is moulded of polypropylene.

To prepare the container according to the invention for the separated storing of two products which are to be mixed only at the time of use, the container will be supplied with a liquid product in the bottle (which constitutes the first compartment). The assembly of retaining sleeve and capsule is placed on the bottle 1 by orientating it in convenient manner with respect to the neck 2 in order that each tooth 10 of the capsule 6 is in register with a catch recess between two successive teeth 3 of the neck 2. Finally the capsule 6 is introduced into the interior of the neck 2 and the rim 4 of the neck is snapped into place in the groove 14 of the sleeve 7. The internal volume defined by the capsule 6 and its retaining sleeve 7 constitutes the second compartment which is filled with an additional pulverulent or liquid product.

Once this operation is complete, the stopper 17 is placed over the bottle 1 on which the assembly 5 has just been attached, and is then force-fitted on the retaining sleeve 7, until a non-releasable connection has been obtained between the two parts, by resilient engagement of the rim 21 of the stopper with the groove 16 of the retaining sleeve.

It is clear that the two compartments defined by the storage container according to the invention are rigorously isolated from one another, without the need for any sealing gasket between the internal volume of the bottle 1 and that of the sleeve-and-capsule assembly 5.

In order to mix the two products contained separately in the first and second compartments of the container, the user must rotate the stopper 17 clockwise or anti-clockwise with respect to the body of the bottle 1. Since the stopper 17 is held by the retaining sleeve 7 against rotation relative thereto, by virtue of co-operation of the ribs defined by the channels 22 and the striations 11*a*, this rotation of the stopper 17 will entrain rotation of the retaining sleeve 7 and consequently of the capsule 6 which it carries, until the teeth 10 of the capsule 6 come into engagement against the teeth 3 of the neck 2. At this point the capsule 6 becomes thus held against further rotation relative to the neck 2, so continued rotational movement on the retaining sleeve 7 through the agency of the stopper 17, will provoke failure of the rupturable peripheral wall zone 8 to release the capsule 6 which, once detached from the retaining sleeve 7, falls into the bottle 1 allowing the additional pulverulent or liquid product contained in the internal volume of the assembly of the retaining sleeve 7 and the capsule 6 to fall into the liquid product. The two products may then be mixed in the absence of the outside atmosphere and without contact with the fingers of the user, simply by shaking the still closed bottle 1.

In order to allow this mixture to be dispensed, the user simply cuts the end 24 of the dispensing spout 23 thereby opening the discharge orifice.

It is well understood that the embodiment described above is in no way limiting and may give rise to several desirable modifications without departing from the scope of the invention as defined by the following claims.

I claim:

1. A container for storing and dispensing a liquid product and an additional product isolated from one another during storage, and for dispensing a mixture of the said products, such container comprising a receptacle having a body and a neck, the body of the receptacle constituting a first compartment in which one of the products is placed; a capsule positioned in said neck, said capsule being in the form of a cup having a lateral wall disposed at least partially in said neck; a stopper covering said capsule and co-operating during storage with said capsule to define a second compartment in which said additional product is placed; external relief means on said cup lateral wall within said neck; internal relief means on said neck positioned to engage against said external relief means to hold said capsule against rotation with respect to said neck; retaining sleeve means adapted to engage said neck and to receive the said stopper externally thereon; means defining a rupturable peripheral wall zone joining said retaining sleeve means to said capsule whereby said capsule is carried by the retaining sleeve means; and means connecting said retaining sleeve means and said stopper for preventing rotation of the stopper relative to said retaining sleeve means.

2. A container as claimed in claim 1, wherein said retaining sleeve means comprises an external skirt, and an internal skirt disposed concentrically with respect thereto; wherein said two skirts being disposed to receive said receptacle neck therebetween in the assembled configuration of the container; and wherein said rupturable peripheral wall zone joins said capsule lateral wall with the said internal skirt of the retaining sleeve means.

3. A container as claimed in claim 2, wherein said retaining sleeve means further includes an annular sealing rib, interposed between said internal and external skirts; and wherein said external skirt and said sealing rib define together a channel constituting catch means for receiving the rim of said neck therein with a snap fit to fix the retaining sleeve means on said neck of the receptacle.

4. A container as claimed in claim 1, wherein said capsule lateral wall is substantially cylindrical and said external relief means thereon comprises several teeth extending parallel to the generatrices of the said cylindrical lateral wall.

5. A container as claimed in claim 4, wherein said neck of the receptacle has a substantially cylindrical internal surface, and said internal relief means thereon comprises several teeth disposed parallel to the generatrices of said cylindrical internal surface.

6. A container as claimed in claim 5, wherein said teeth on the neck include concave radially inner faces conforming to a first right circular cylinder, and said teeth on the lateral wall of said capsule have convex radially outer faces conforming to a second right circular cylinder.

7. A container as claimed in claim 6, wherein the diameter of said second right circular cylinder is less than the diameter of the said cylindrical surface of the neck between two adjacent teeth, and the diameter of the said first right circular cylinder is greater than the diameter of said cylindrical lateral wall of the capsule between two adjacent teeth thereof.

8. A container as claimed in claim 3, wherein said retaining sleeve means includes an inner wall surface; wherein said stopper comprises: an external skirt of generally cylindrical form disposed coaxially with said neck of the receptacle, and an annular sealing rib positioned to bear against one end of the said inner wall surface of the retaining sleeve means; and wherein said stopper skirt surrounds said stopper sealing rib.

9. A container as claimed in claim 8, wherein said external skirt and said sealing rib of the stopper define together an annular recess; wherein a catch bead is formed in said annular recess; wherein said retaining sleeve means includes means defining an annular groove on one end thereof; and wherein said stopper is adapted to be fixed to the retaining sleeve means by ratchet action engagement of said catch bead in said annular groove on said one of the retaining sleeve means.

10. A container as claimed in claim 8, wherein said generally cylindrical external skirt of the stopper comprises internally thereof means defining alternate ribs and channels disposed side-by-side therearound and parallel to the generatrices of its internal cylindrical surface, and said external skirt of the retaining sleeve means has a part of its cylindrical surface situated in register with said channels of the skirt, and includes on said part of the cylindrical surface striations disposed side-by-side and parallel to the generatrices of said cylindrical surface, and wherein said ribs of the skirt engage with the striations of the retaining sleeve means, whereby said ribs, and channels of the skirt and said striations of the retaining sleeve means constitute the means for holding the stopper against rotation with respect to the retaining sleeve means.

11. A container as claimed in claim 1, wherein said stopper comprises a dispensing spout.

12. A container as claimed in claim 11, wherein said dispensing spout includes means defining a discharge orifice at the free end of said dispensing spout, and a wall zone closing said discharge orifice and intended to be cut or torn away at the moment of dispensing.

* * * * *